US009462864B2

(12) United States Patent
Sirichai

(10) Patent No.: US 9,462,864 B2
(45) Date of Patent: Oct. 11, 2016

(54) REVERSIBLE CASE FOR AN ELECTRONIC DEVICE

(71) Applicant: Saharut Sirichai, Bangkok (TH)

(72) Inventor: Saharut Sirichai, Bangkok (TH)

(73) Assignee: WORLD RICHMAN MANUFACTURING CORPORATION, Elgin, IL (US)

( * ) Notice: Subject to any disclaimer, the term of this patent is extended or adjusted under 35 U.S.C. 154(b) by 107 days.

(21) Appl. No.: 14/659,852

(22) Filed: Mar. 17, 2015

(65) Prior Publication Data

US 2015/0296942 A1 Oct. 22, 2015

Related U.S. Application Data

(60) Provisional application No. 61/954,519, filed on Mar. 17, 2014.

(51) Int. Cl.

| | |
|---|---|
| ***A45C 11/00*** | (2006.01) |
| ***A45C 13/00*** | (2006.01) |
| *A45C 13/02* | (2006.01) |

(52) U.S. Cl.

CPC ..... *A45C 11/00* (2013.01); *A45C 13/005* (2013.01); *A45C 2011/002* (2013.01); *A45C 2011/003* (2013.01); *A45C 2013/025* (2013.01); *A45C 2013/026* (2013.01); *A45C 2200/15* (2013.01)

(58) Field of Classification Search

CPC ..... A45C 11/00; A45C 13/005; A45C 2011/002; A45C 2011/03; A45C 2013/025; A45C 2200/15

USPC ..... 206/45.2, 45.23, 45.24, 320; 455/575.1, 455/575.8; 361/679.01, 679.02, 679.03

See application file for complete search history.

(56) References Cited

U.S. PATENT DOCUMENTS

| | | | | |
|---|---|---|---|---|
| 3,562,796 | A | 2/1971 | Jacobson | |
| 4,989,926 | A | 2/1991 | Snow, Jr. | |
| 5,128,829 | A | 7/1992 | Loew | |
| 5,184,722 | A | 2/1993 | Shin et al. | |
| 5,363,969 | A | 11/1994 | Shen | |
| D379,048 | S | 5/1997 | Ros et al. | |
| 5,845,366 | A | 12/1998 | Kuroda | |
| 6,029,871 | A | 2/2000 | Park | |
| 6,078,908 | A | 6/2000 | Schmitz | |
| 6,239,968 | B1 | 5/2001 | Kim et al. | |
| 6,276,414 | B1 * | 8/2001 | Bibb | A45C 1/06 150/131 |
| 6,445,577 | B1 | 9/2002 | Madsen et al. | |
| 6,971,622 | B2 | 12/2005 | Ziegler et al. | |
| 7,032,984 | B2 | 4/2006 | Kim et al. | |

(Continued)

*Primary Examiner* — Chun Cheung

(74) *Attorney, Agent, or Firm* — Christopher J. Scott

(57) ABSTRACT

A reversible case construction encases an electronic device and enables a user to selectively display an outer case material. The reversible case construction includes a device-holding mechanism, and a multi-layer, multi-section device-concealing panel assembly. The device-holding mechanism is sized and shaped to removably receive an electronic device. The device-concealing panel assembly includes first and second material portions. The first and second material portions each include outer surfacing, a panel assembly-to-holder interface section, an interface-cover section, and a device-encasing section. The interface-cover sections and device-encasing sections are attached to one another for providing a reversible panel assembly. The reversible panel assembly is pivotal relative to the device-holding mechanism. Thus, the first and second material portions are selectively presentable for displaying the outer case material.

20 Claims, 22 Drawing Sheets

(56) References Cited

U.S. PATENT DOCUMENTS

| | | | | |
|---|---|---|---|---|
| 7,111,773 | B1 | 9/2006 | So et al. | |
| 7,412,995 | B2 * | 8/2008 | Arcese | A45C 3/06 150/103 |
| 7,621,398 | B2 * | 11/2009 | Sugibuchi | B42D 5/005 206/449 |
| 7,743,999 | B1 | 6/2010 | Griffin | |
| 8,047,365 | B1 | 11/2011 | Lin et al. | |
| D654,263 | S | 2/2012 | Mahmood et al. | |
| 8,348,055 | B2 | 1/2013 | Loban | |
| 8,459,453 | B2 | 6/2013 | Parker et al. | |
| 2004/0157653 | A1 | 8/2004 | Kato | |
| 2007/0165371 | A1 | 7/2007 | Brandenburg | |
| 2009/0120980 | A1 | 5/2009 | Calayo | |
| 2011/0297564 | A1 | 12/2011 | Kim et al. | |
| 2012/0074006 | A1 | 3/2012 | Monaco et al. | |
| 2013/0032617 | A1 | 2/2013 | Adelman et al. | |
| 2013/0178155 | A1 | 7/2013 | Shulenberger | |
| 2014/0238876 | A1 * | 8/2014 | Chen | G06F 1/1626 206/45.2 |

* cited by examiner

REVERSIBLE CASE FOR AN ELECTRONIC DEVICE

PRIOR HISTORY

This patent application claims the benefit of pending U.S. Provisional Patent Application No. 61/954,519 filed in the United States Patent and Trademark Office on 17 Mar. 2014.

BACKGROUND OF THE INVENTION

1. Field of the Invention

The disclosed invention generally relates to a case construction for encasing an electronic device such as a laptop type computer, tablet type computer or mobile communications device. More particularly, the disclosed invention provides a reversible case construction for enabling a user to encase an electronic device and selectively orient an outer casing material for visual display.

2. Brief Description of the Prior Art

Case constructions for use in combination with electronic devices such as tablet type computers and the like are well known in this field of art. While the basic function of a basic case construction is to protect and/or enclose the device it encases, the art continues to develop with an eye toward enhancing functionality of the case constructions so as to provide the user with various means of manipulating and/or re-positioning the devices.

For example, it may be desirable to provide a case having first and second decorative case materials which can be selectively chosen to outside orientation for providing passersby with visual and/or tactile sensory information from either of two decorative case materials while simultaneously protecting the encased device within or as attached to the basal case construction. When the tablet computer or similar device is supported in its carrying case during use thereof, the multi-function use of the case provides great advantages for utility thereof, while keeping a structure for the improved use to a minimum.

It is further noted that tablet type computers and the like are manufactured in a variety of sizes and shapes. Accordingly, it is beneficial for a device mounting mechanism to adjust to the size and/or contours of the respective device(s), while still providing the desired holding and outer cover re-positioning capabilities. A few of the more pertinent prior art patent-related disclosures relating to cradle-like devices for holding and enabling the re-positioning of the devices they hold are described hereinafter.

United States Patent Application Publication No. 2006/0187696 ('696 Publication), authored by Lanni, discloses a Cradle for Receiving an Adapter. The '696 Publication describes a cradle casing having a DC/DC adapter to receive DC power from a DC power source and generate a first DC power signal. A sleeve accepts an AC/DC adapter, and guides movement of the AC/DC adapter when the AC/DC adapter is inserted into the cradle casing. The AC/DC adapter is capable of receiving AC power from an AC power source and generating a second DC power signal. A circuit receives at least one of the first DC power signal and the second DC power signal and outputs a third DC power signal.

United States Patent Application Publication No. 2008/0002369 ('369 Publication), authored by Carnevali, discloses a Portable Device Docking Station. The '369 Publication describes an external expanding apparatus or "docking station" operable with a portable computer device of a type having a display unit having a display screen on an inner surface thereof and a hard shell backing surface opposite thereof and pivotally mounted on a substantially rigid casing having a pair of locating holes adjacent to opposite corners of a substantially planar bottom surface thereof, and an input/output (I/O) connector positioned on a back plane thereof with a pair of positioning apertures provided on opposite sides thereof.

United States Patent Application Publication No. 2011/0261509 ('509 Publication), authored by Xu et al., discloses a Docking Cradle with Floating Connector Assembly. The '509 Publication describes a docking cradle for a portable electronic device that includes a floating connector assembly. The floating connector assembly isolates a portable electronic device connected to the connector assembly from at least some of the shock, vibration or other motion imposed on the rest of the docking cradle.

The connector assembly is positioned above a base frame and comprises a platform, a device interface on the platform, a device securing mechanism connected to the platform and connectable to the portable electronic device to physically secure the portable electronic device to the connector assembly; and at least one connector assembly spring connecting the connector assembly to the base frame such that the connector assembly is movable laterally relative to the base frame.

United States Patent Application Publication No. 2012/0075789 ('789 Publication), authored by DeCamp et al., discloses a Swiveling Base for a Portable Computing Device. The '789 Publication describes certain swiveling bases for portable computing devices. A swiveling base according to the '789 Publication includes a base member and a rotatable member. The base member can be placed on a flat surface and rotatably supports the rotatable member. The rotatable member releasably secures the portable computing device and can rotate relative to the base member to reorient a display of the portable computing device.

The swiveling bases may further include a control component disposed on the base member. The control component is disposed on the base member and facilitates user interaction with a computing application being executed on the portable computing device. The control component may be, for example, a button, a joystick, a D-pad, a tactile sensor pad, a touch-sensitive D-pad, a spherical trackball, a slider, or a sliding disk.

From a review of the foregoing citations in particular, and from a consideration of the prior art in general, it will be seen that the prior art thus perceives a need for a reversible case construction for enabling a user to removably receive an electronic device as exemplified by a tablet type computer and selectively cover that removably received electronic device with an encasing panel assembly with select surfacing of the case or cover construction being outwardly presented as summarized in more detail hereinafter.

SUMMARY OF THE INVENTION

Among the many objectives of this invention is the provision of a reversible case construction for encasing and selectively covering and displaying an electronic device such as a notebook, laptop, or tablet type computer or similar device. These and other readily identifiable objectives of the invention (which other objectives become clear by consideration of the specification, claims and drawings as a whole) are met by providing a reversible case construction for an electronic device that cooperates with an electronic device for selectively displaying and encasing the same.

To achieve these and other readily identifiable objectives, the present invention provides a reversible case construction for encasing an electronic device and selectively displaying an outer case material. The reversible case construction according to the present invention preferably and summarily comprises a device-holding mechanism and a multi-layer, multi-section device-concealing panel assembly.

The device-holding mechanism is preferably sized and shaped to removably receive an electronic device, and comprises an anterior device-receiving section and posterior holder surfacing. The multi-layer, multi-section device-concealing panel assembly comprises a first material portion and a second material portion, the first and second material portions each comprising inner attachment surfacing, outer exposable surfacing, a panel assembly-to-holder interface section, an interface-cover section, and a device-encasing section.

The inner attachment surfacing of the interface-cover sections and device-encasing sections is attached to one another for providing a reversible panel assembly. The inner attachment surfacing of the panel assembly-to-holder interface sections is attached to structure associated with the device-holding mechanism for providing a bifurcated interface panel layer.

The reversible panel assembly is pivotal relative to the bifurcated interface panel layer about a first pivot axis located adjacent a line of bifurcation in the bifurcated interface panel layer. The first and second material portions thereby are selectively presentable for displaying the outer case material.

The multi-layer, multi-section device-concealing panel assembly may preferably further comprise an interface structural layer, which interface structural layer is attached to the posterior holder surfacing and the inner interface surfacing for connecting the multi-layer, multi-section device-concealing panel assembly to the device-holding mechanism.

The first and second material portions may preferably comprise differing physical properties for enabling the user to select a preferred physical property from the group consisting of the differing physical properties for outward presentation of the preferred physical property. More particularly, the first and second material portions comprise differing visual properties, the differing visual properties for enabling the user to select a preferred visual property from the group consisting of the differing visual properties for outward presentation of the preferred visual property.

The panel assembly-to-holder interface sections may preferably comprise an interface magnetic material layer and the device-encasing sections may preferably comprise an encasing magnetic material layer. The interface and encasing magnetic material layers are positionable so as to become substantially parallel, opposed and magnetically attractive to one another when the reversible case construction is in a closed configuration for enhancing the closed condition of the reversible case construction.

The interface-cover sections may also comprise a cover magnetic material layer such that the cover and interface magnetic material layers are positionable so as to become substantially parallel, opposed, and magnetically attractive to one another for enhancing the closed condition.

Select magnetic material layers are preferably embedded within the first and second material portions, which select magnetic material layers are selected from the group consisting of the interface, device-encasing and cover magnetic material layers. The select magnetic material layers are so embedded for enhancing the visual appeal of the reversible case construction.

The device-encasing sections preferably comprise first and second panel sections. The second panel sections are pivotal relative to the first panel sections about a second pivot axis extending intermediate the first and second panel sections. The pivotal first and second panel sections may thus form basal support for the device-holding mechanism and enable the user to support the device-holding mechanism in an oblique orientation relative to the first panel sections when the reversible case construction is in an open configuration.

In an alternative embodiment, the interface-cover sections are pivotally attached to the panel assembly-to-holder interface sections at opposed attachment points opposite an interface section aperture. The interface section aperture is designed to accommodate a rotation mechanism, which rotation mechanism rotatably connects the device-holding mechanism to the panel assembly-to-holder interface sections.

Other objects of the present invention, as well as particular features, elements, and advantages thereof, will be elucidated or become apparent from, the following description and the accompanying drawing figures.

BRIEF DESCRIPTION OF THE DRAWINGS

Other features and objectives of my invention will become more evident from a consideration of the following brief description of patent drawings.

DETAILED DESCRIPTION OF THE PREFERRED EMBODIMENTS

Figure 1:
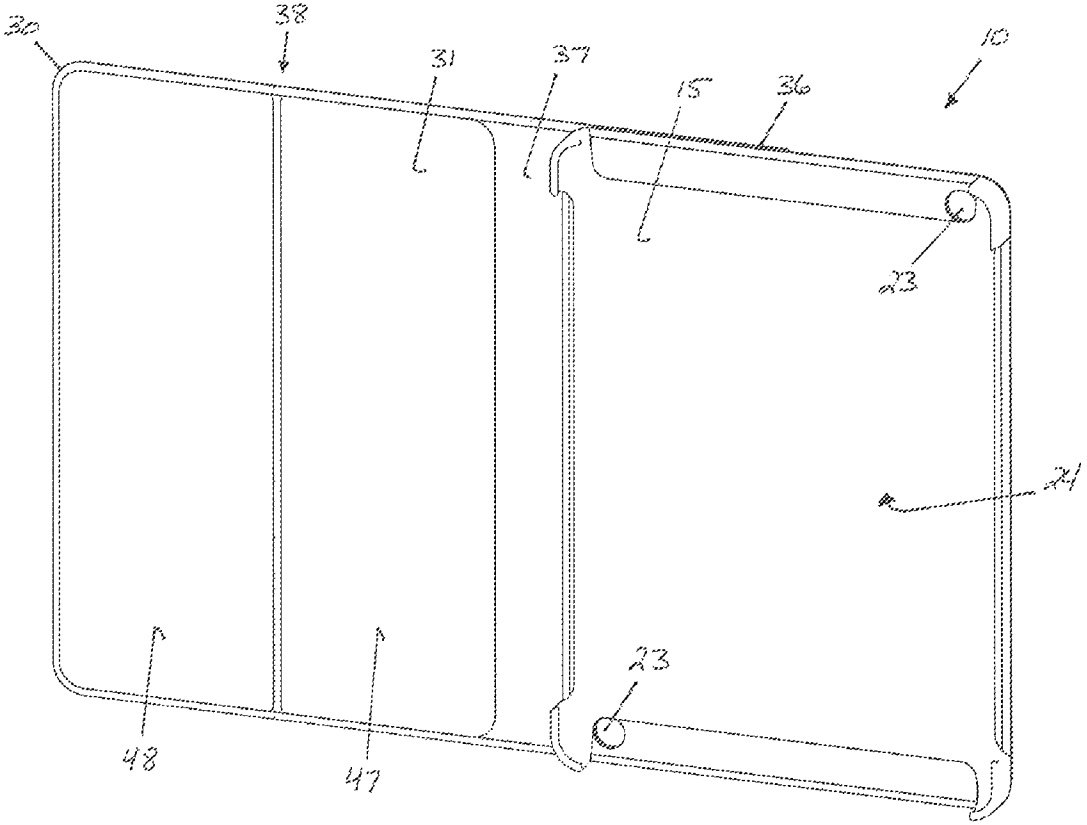
FIG. 1 is a first frontal perspective view of a preferred reversible case construction according to the present invention showing a cradle-covering portion in a first open configuration to show a first side of the cradle-covering portion.
Figure 2:
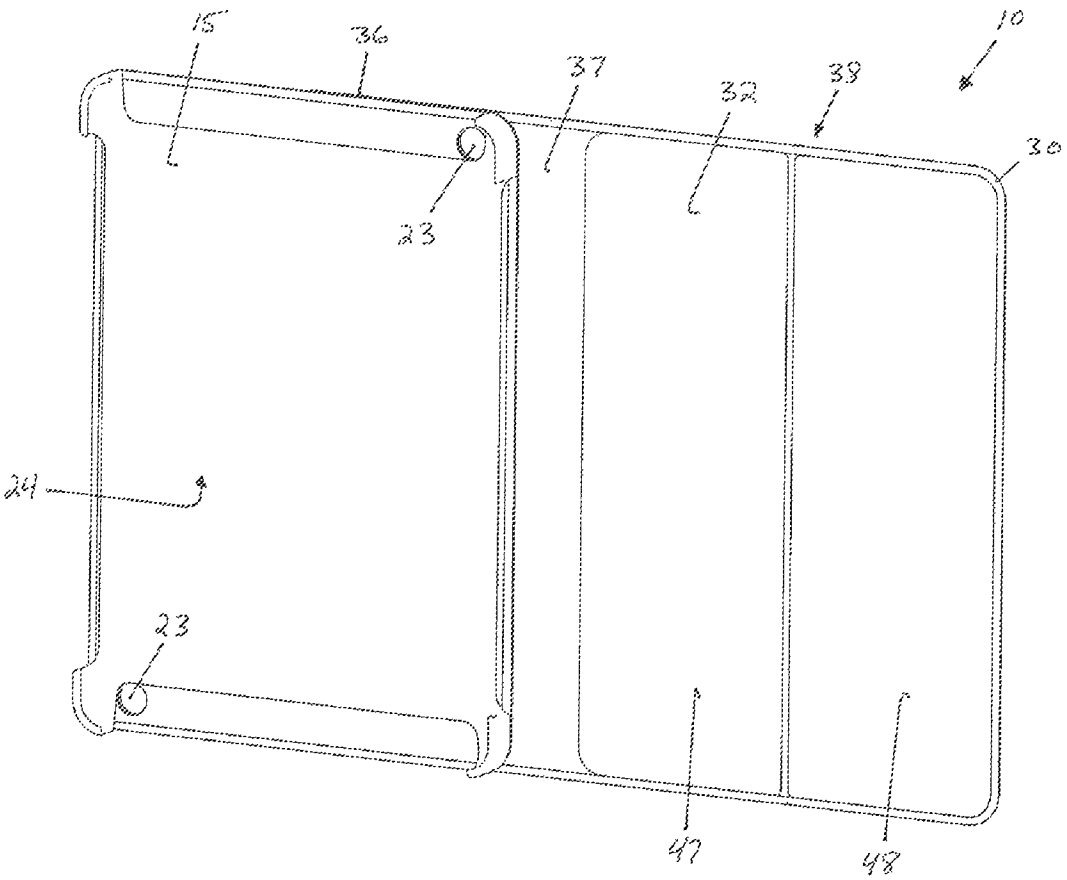
FIG. 2 is a second frontal perspective view of the preferred reversible case construction according to the present invention showing the cradle-covering portion in a second open configuration to show a second side of the cradle-covering portion.

Referring now to the drawings with more specificity, the present invention preferably provides a reversible case construction as variously exemplified by four exemplary embodiments as at primary or preferred embodiment 10, and alterative exemplary embodiments 11, 12, 13, and 14. The reversible case construction according to the present invention basically functions to (a) encase an electronic device as generically depicted and referenced at 110, and (b) enable a user to selectively display an outer preferred case material in a reversible manner as will be more fully understood from a consideration of these detailed descriptions.

To achieve these primary functions, the reversible case construction according to the present invention preferably comprises a device-holding mechanism as variously exemplified by a first fixed cradle construction as at 15, a second fixed cradle construction as at 15', a third fixed cradle construction as at 16, a rotatable cradle assembly as at 17, a first universal device-holding board as at 18, and a second universal device-holding board as at 19. The first and second universal device-holding boards 18 and 19 are basically variants of the same type of device-holding mechanism incorporating elastomeric material as at 20 having variously shaped apertures 21 formed therein for forming straps 55 that resiliently receive and retain corners 22 of an electronic device 110 for resiliently retaining or holding such a device 110.

Similarly, the first, second, and third fixed cradle constructions 15, 15' and 16 are basically variants of the same type of device-holding mechanism incorporating or being formed from a relatively more rigid material as compared to the elastomeric material 20 sized and shaped to receive a specifically sized and shaped electronic device 110. The cradle constructions 15, 15' and 16 basically only differ structurally in terms of where device-accommodating apertures or cut-outs 23 may be preferably formed in the cradle construction 15, 15', 16 for cooperating with various functional features of the electronic device 10 received thereby.

The device-holding mechanism according to the present invention, as variously exemplified at 10, 11, 12, 13, and 14, is preferably and essentially sized and shaped to removably receive and retain an electronic device 110, and preferably comprises an anterior device-receiving section 24, posterior holder surfacing as at 25, a holder length as at 26 (extending in a top-to-bottom dimension), a holder width as at 27, and a holder thickness as at 28. The device-holding mechanism according to the present invention may be of any number of types of constructions and made cooperable with a multi-layer, multi-section device-concealing panel assembly as at 30, which multi-layer, multi-section device-concealing panel assembly 30 is believed central to the practice of the present invention.

The multi-layer, multi-section device-concealing panel assembly 30 according to the present invention preferably and essentially comprises a first material portion or layer as at 31 and a second material portion or layer as at 32. The first and second material portions or layers 31 and 32 each preferably comprise inner attachment surfacing 33, outer exposed or selectively exposable surfacing 34, a panel assembly-to-holder interface section as at 35, an interface-cover section as at 36, a holder-device edge-traversing section 37, and a device-encasing section as at 38.

The inner attachment surfacing 33 of the interface-cover sections, the holder-device edge-traversing sections 37 and device-encasing sections 38 are attached to one another for providing a reversible case panel assembly. The inner attachment surfacing 33 of the panel assembly-to-holder interface sections 35 are preferably attached to structure associated with the device-holding mechanism for providing a (single) bifurcated interface panel layer as at 39.

The preferred structure associated with the device-holding mechanism may be preferably defined by an interfacing panel assembly-to-holder structural layer or board as at 40. Thus, the multi-panel, multi-layer device-concealing panel assembly 30 may be said to further preferably comprise the interfacing panel assembly-to-holder structural layer or board 40. The panel assembly-to-holder structural layer or board 40 is fixedly attached to the posterior holder surfacing 25 and the inner interface surfacing 33 for connecting the multi-panel, multi-layer device-concealing panel assembly 30 to the select device-holding mechanism. The interface structural layer or board 40 and panel assembly-to-holder interface sections 35 may also be outfitted with device-accommodating apertures or cut-outs 23.

Figure 3:
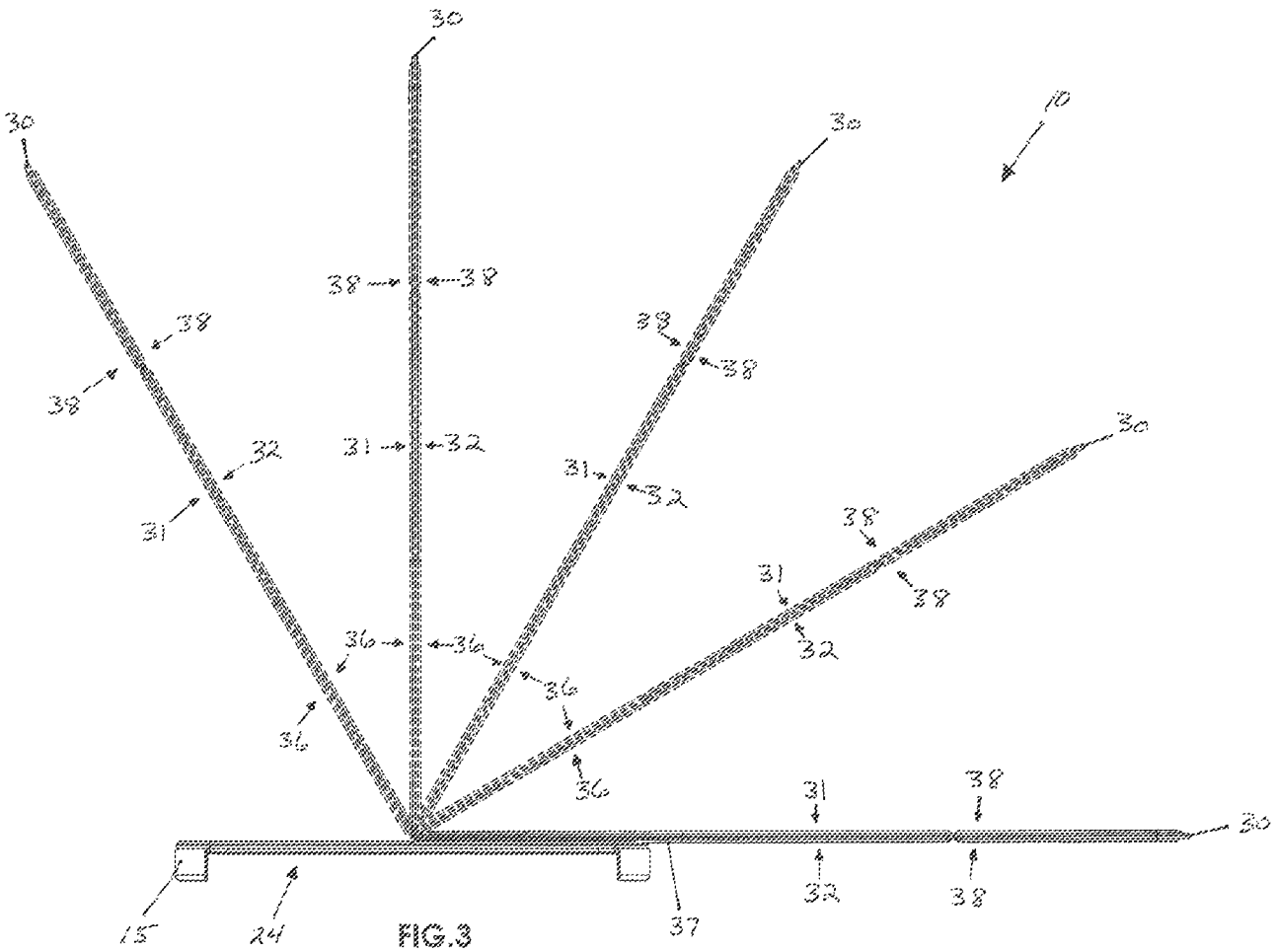
FIG. 3 is a first edge view of the preferred reversible case construction according to the present invention showing the cradle-covering portion in the second open configuration in solid lines and the cradle-covering portion in a series of intermediary open configurations between the second open configuration and the first open configuration in broken lines.
Figure 4:
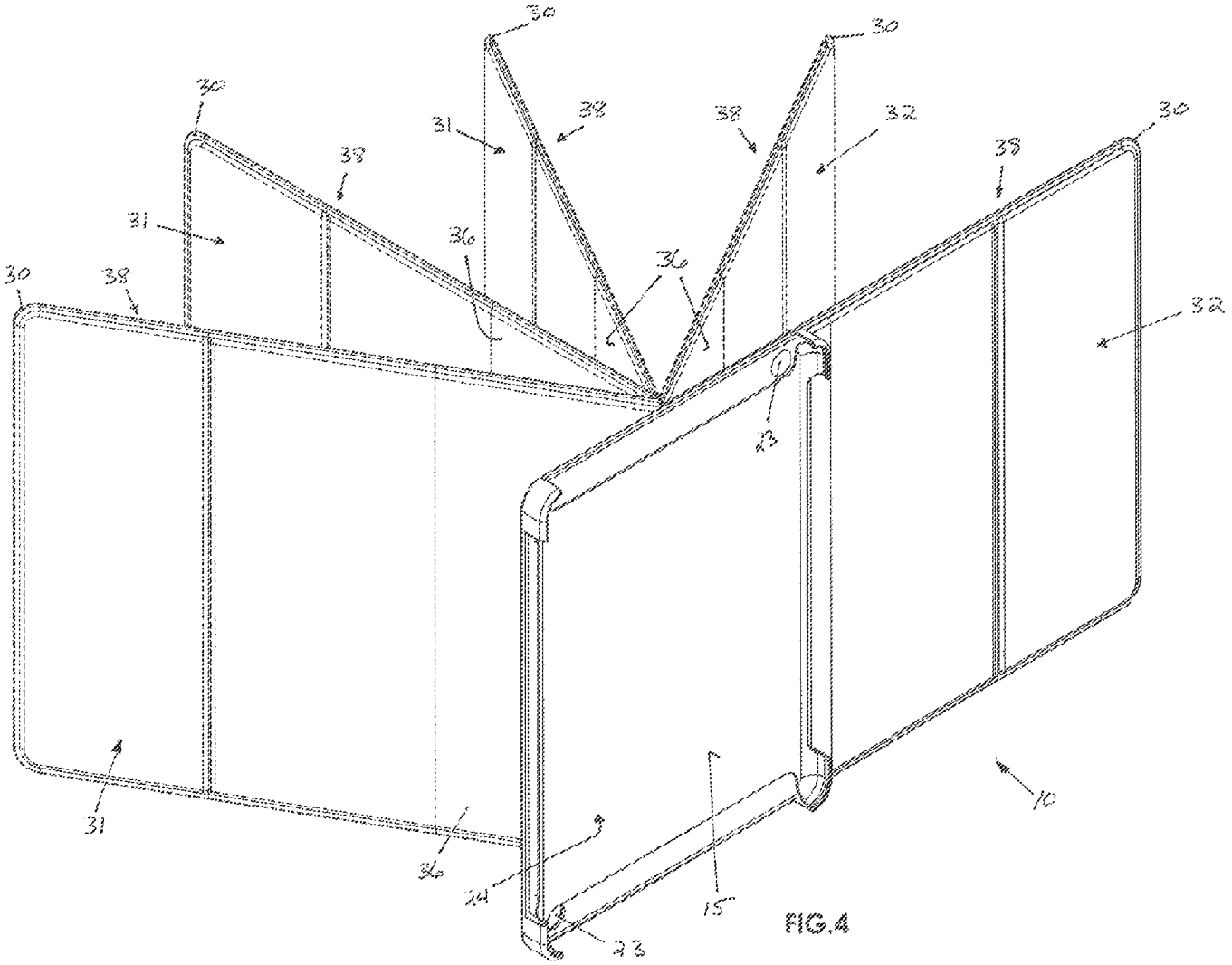
FIG. 4 is a third frontal perspective view of the preferred reversible case construction according to the present invention showing the cradle-covering portion in the second open configuration in solid lines and the cradle-covering portion in a series of intermediary open configurations between the second open configuration and the first open configuration in broken lines.
Figure 5:
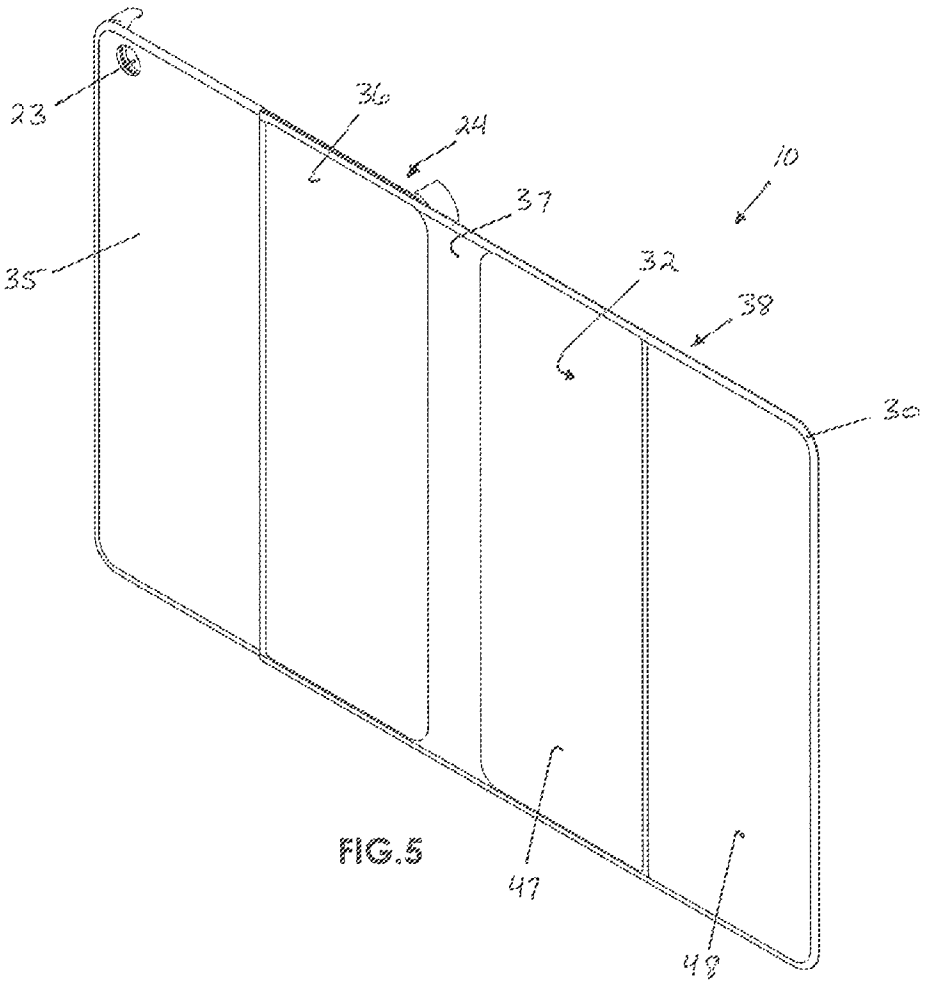
FIG. 5 is a first rear perspective view of a preferred reversible case construction according to the present invention showing the cradle-covering portion in the first open configuration and showing the second side of the cradle-covering portion.
Figure 6:
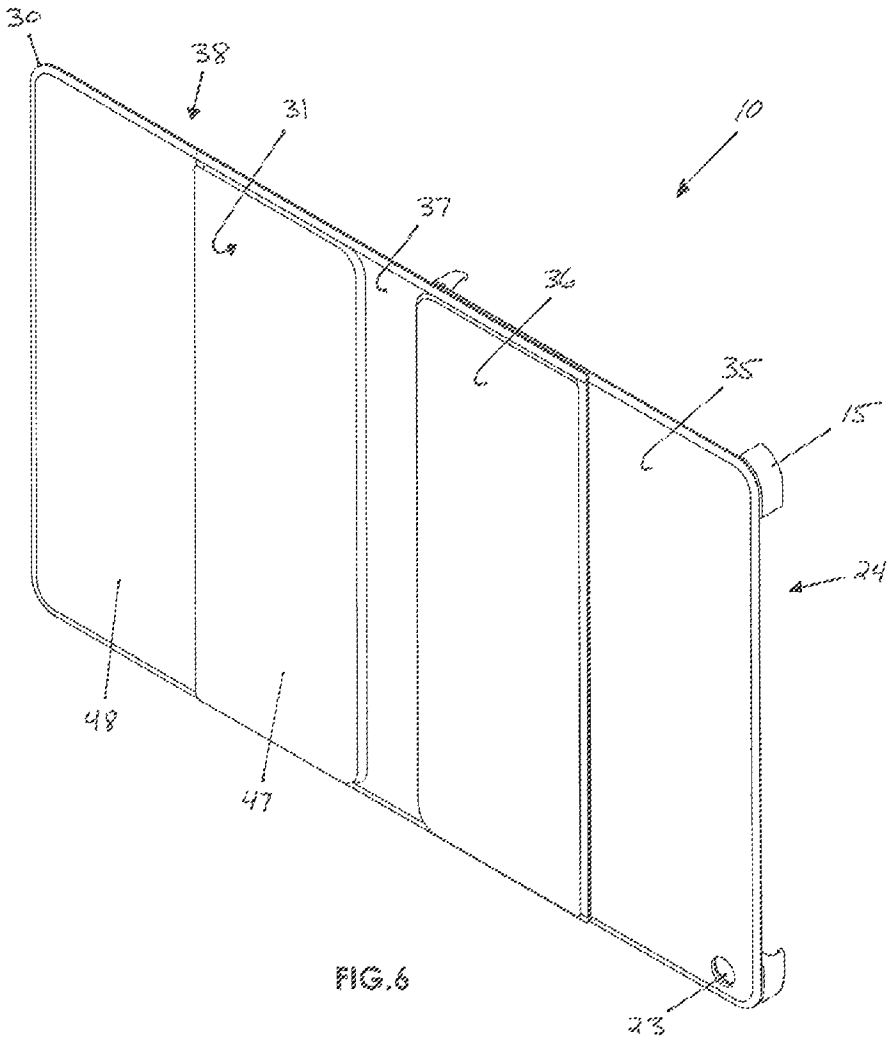
FIG. 6 is a second rear perspective view of the preferred reversible case construction according to the present invention showing the cradle-covering portion in the second open configuration to show the first side of the cradle-covering portion.
Figure 7:
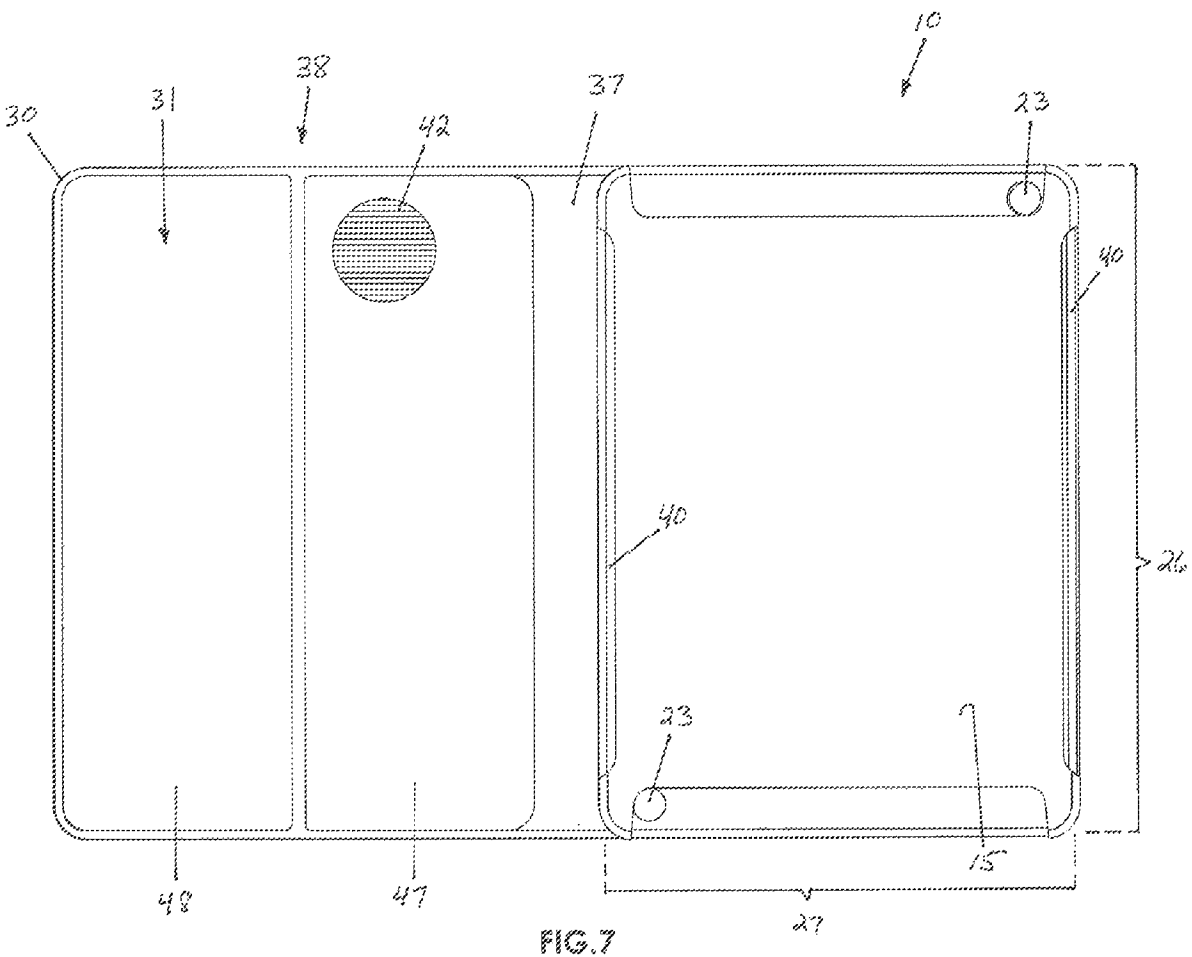
FIG. 7 is a first frontal plan view of the preferred reversible case construction according to the present invention showing the cradle-covering portion in the first open configuration to show the first side of the cradle-covering portion with first coloration depicted in a small circular section.
Figure 8:
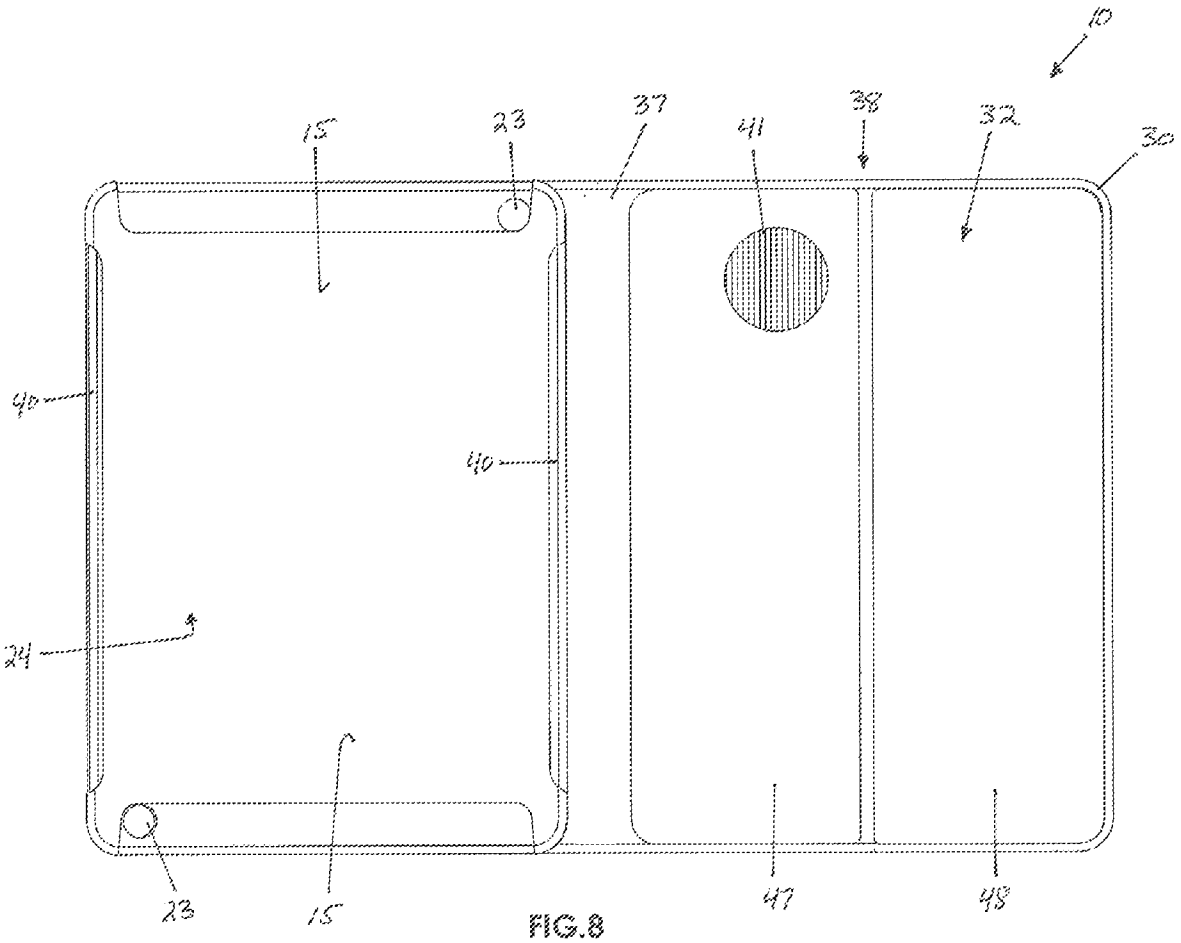
FIG. 8 is a second frontal plan view of the preferred reversible case construction according to the present invention showing the cradle-covering portion in the second open configuration to show the second side of the cradle-covering portion with second coloration depicted in a small circular section.
Figure 9:
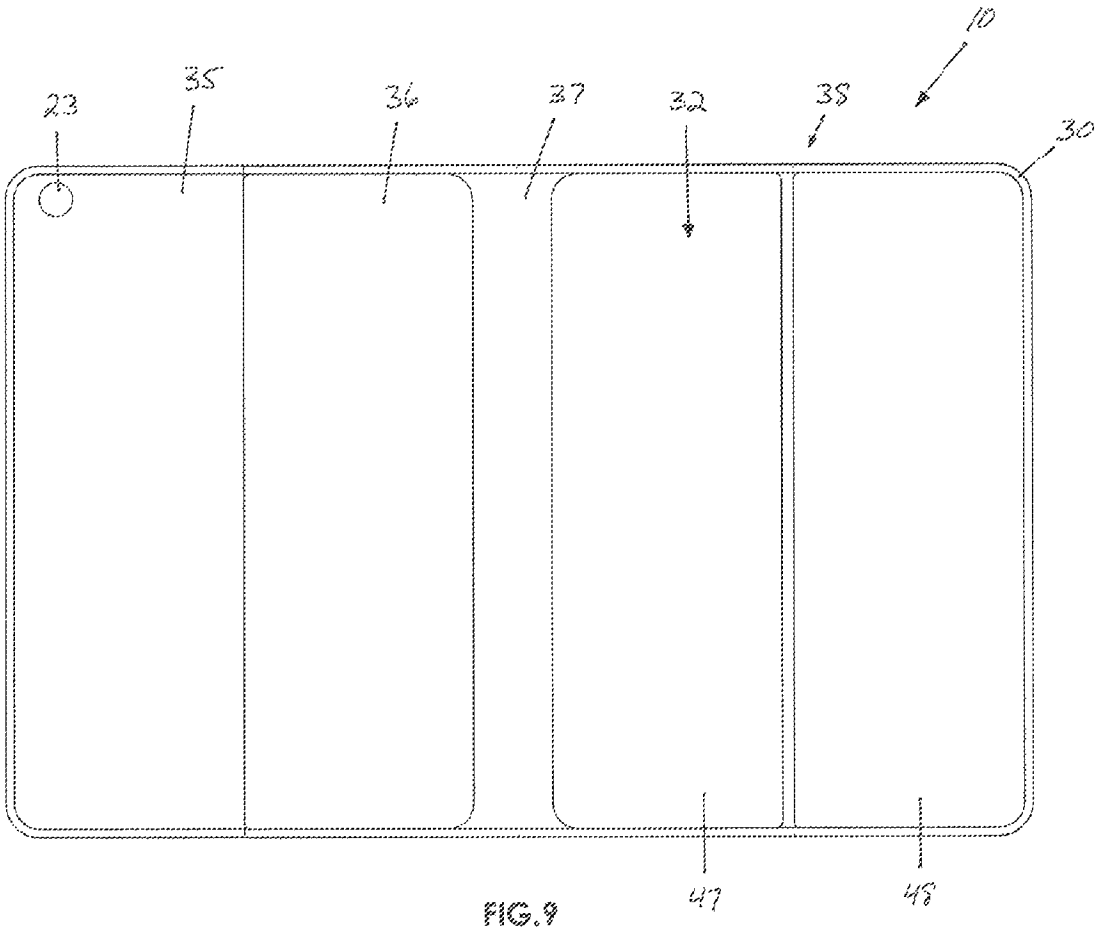
FIG. 9 is a rear plan view of a preferred reversible case construction according to the present invention showing the cradle-covering portion in the first open configuration and showing the second side of the cradle-covering portion.

The reversible panel assembly, comprising the noted sections or panel portions, is preferably pivotal relative to the bifurcated interface panel layer 39 about a first or primary pivot axis 100 basically located at or adjacent the line of bifurcation 101 in the bifurcated interface panel layer 39. FIGS. 3 and 4 attempt to depict the reversible panel assembly being rotated about the pivot axis 100 in various phantom stages for reversing the reversible panel assembly relative to the device-holding mechanism as exemplified by cradle 15.

Reversible properties are well known in the arts and typically provide two finished usable sides or provide some article that is usable with either of two sides in an outward manner. Accordingly, the first and second material portions 31 and 32 preferably comprise differing physical properties, including but not limited to differing perceptually tactile and visual properties for enabling the user to select a preferred physical property from the group consisting of the differing physical properties for outward presentation of the preferred physical property at any given time.

In this regard, the first and second material portions 31 and 32 primarily and preferably comprise differing visual properties for enabling the user to select a preferred visual property from the group consisting of the differing visual properties for outward appearances. Comparatively referencing FIGS. 7, 8, 10A, 11A, 11B, 11C, 14, 15, 16, and 16B the reader will there see depictions of vertical hatch markings as at 41 and horizontal hatch markings as at 42. Vertical hatch markings 41 represent a first group of physical (e.g. visual) properties and horizontal hatch markings 42 represent a second group of physical (e.g. visual) properties.

The vertical hatch markings 41 have been chosen to represent a first type of physical property only and should not be construed to embrace only a first type of coloration characterized by red or pink under the color hatch marking examples of 37 C.F.R. 1.84(n). Similarly, horizontal hatch markings 42 have been chosen to represent a second type of physical property only and should not be construed to embrace only a second coloration characterized by blue under the color hatch marking examples of 37 C.F.R. 1.84(n).

As indicated, the first and second material portions 31 and 31 each preferably comprise a holder-device edge-traversing section 37. The holder-device edge-traversing section(s) 37 are preferably dimensioned for traversing the holder edge thickness 28 as well as the thickness of the panel assembly-to-holder structural layer or board 40 for enabling the device-encasing section(s) 38 to more properly cover or encase the electronic device 110 as received in the select device-holding mechanism when the reversible case construction is in a closed configuration as generally depicted in phantom in FIG. 10, and as generally further depicted in FIGS. 12, 13, and 16-18.

The panel assembly-to-holder interface sections 35 may further preferably comprise an interface magnetic material layer as at 43 and the device-encasing sections comprise an encasing magnetic material layer as at 44. The interface and encasing magnetic material layers 43 and 44 are substantially parallel and opposed when the reversible case construction is in the closed configuration and thus are magnetically attractive to one another as at force vectors 102 for enhancing the closed condition of the reversible case construction when in the closed configuration.

Similarly, the interface-cover sections 36 may further preferably comprise a cover magnetic material layer as at 45. The cover and interface magnetic material layers 45 and 43 are substantially parallel, opposed, and magnetically attractive to one another for enhancing the closed condition of the reversible case construction when in the closed configuration. Arrows 103 in FIGS. 10 and 10A attempt to depict an attractive force between the interface magnetic material layer 43 of the panel assembly-to-holder interface section 35 of the first material layer or portion 31 and the cover magnetic material layer 45 of the interface-cover section(s) 36.

Figure 10:
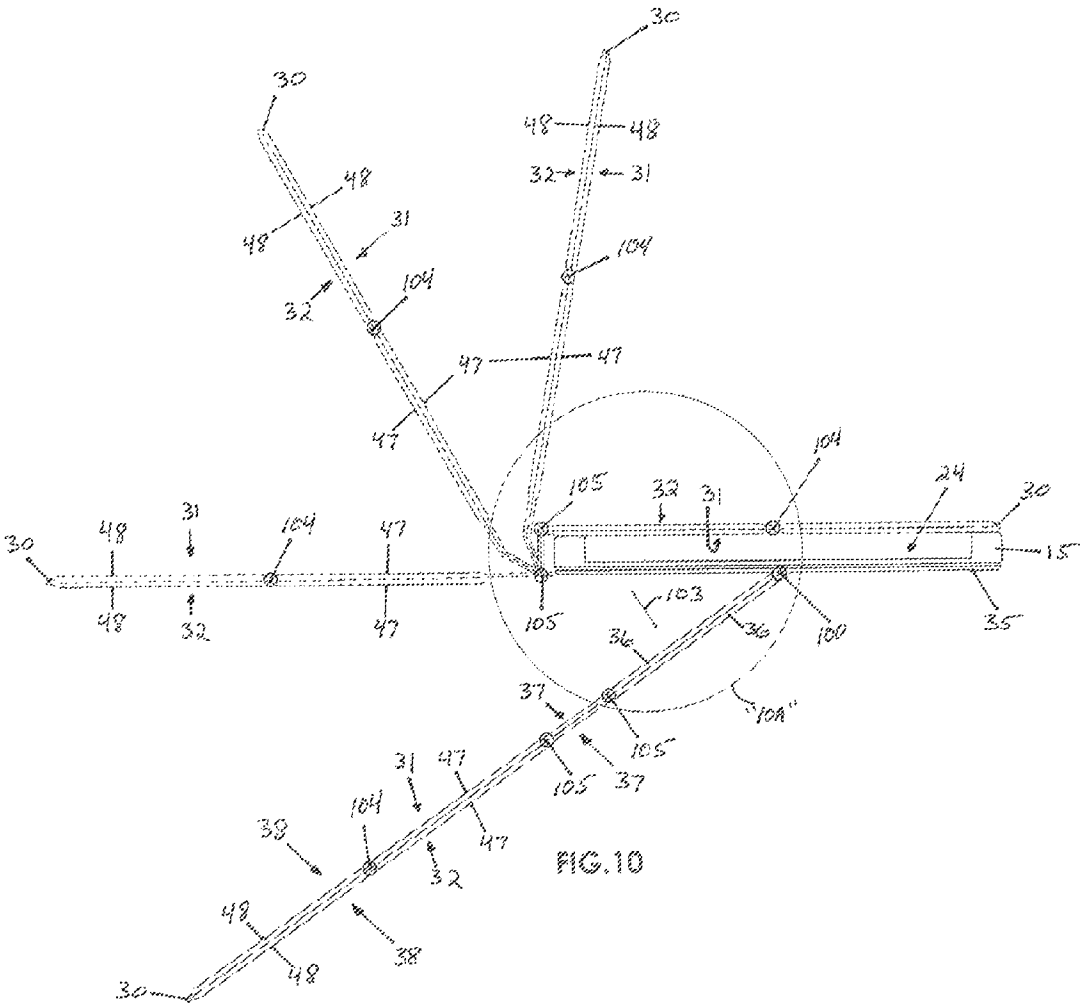
FIG. 10 is a second edge view of the preferred reversible case construction according to the present invention showing the cradle-covering portion in a third open configuration in solid lines and the cradle-covering portion in a series of intermediary open configurations between the third open configuration and a closed configuration.
Figure 10A:
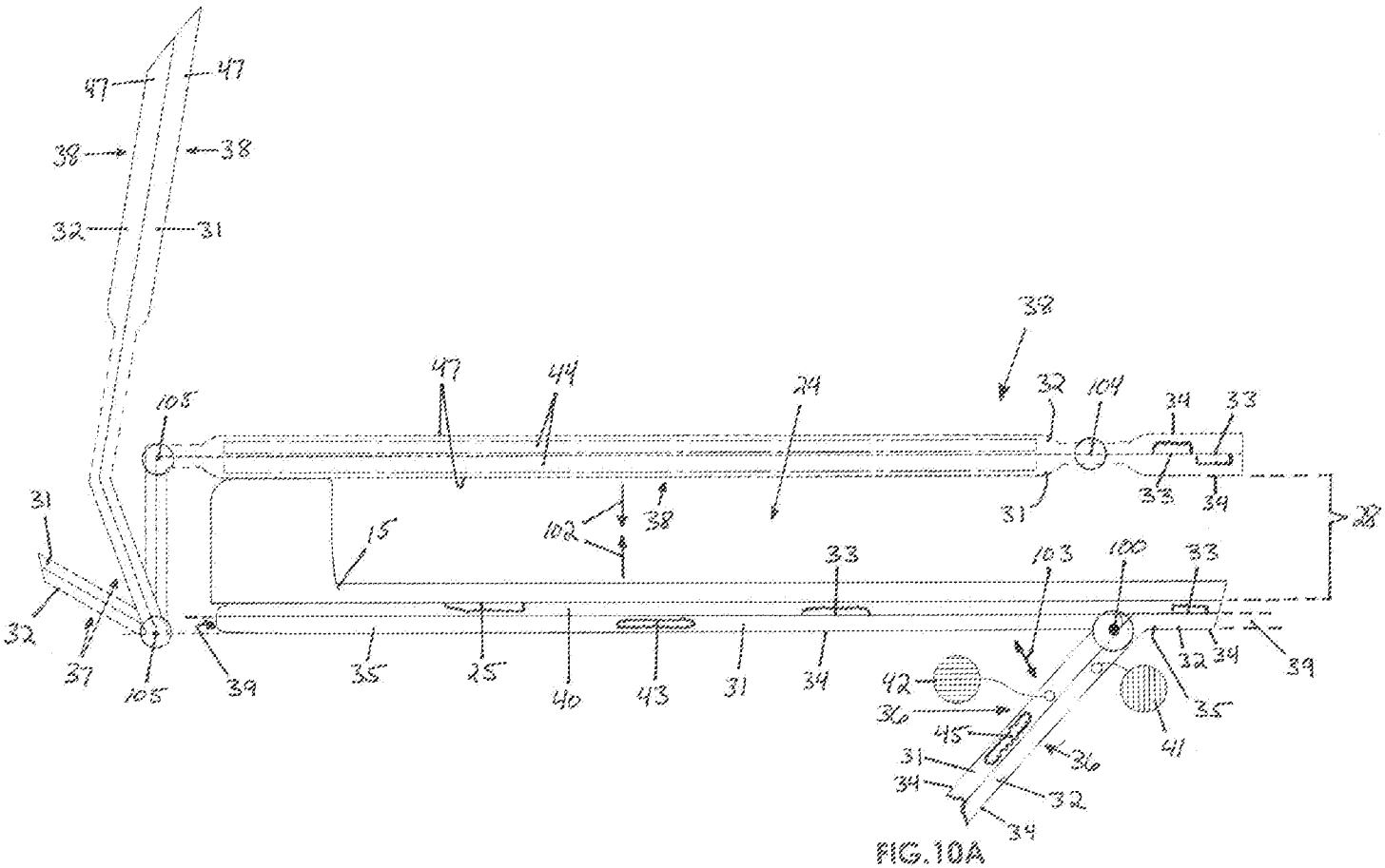
FIG. 10A is an enlarged fragmentary sectional view of portions of the illustrative matter otherwise depicted in FIG. 10, enlarged for greater clarity of said portions.
Figures 11, 11A, 11B, 11C:
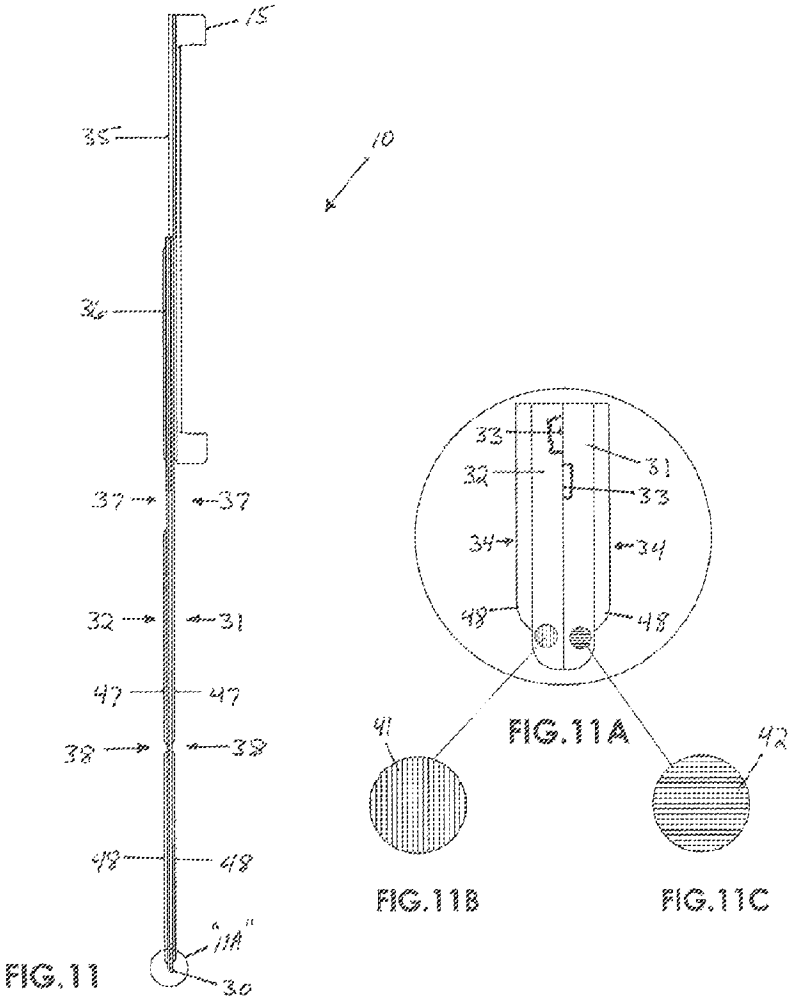
FIG. 11 is a third edge view of the preferred reversible case construction according to the present invention showing the cradle-covering portion in the first open configuration.
FIG. 11A is an enlarged fragmentary sectional view of the lowermost structures otherwise depicted in FIG. 11, enlarged for greater clarity of said structures.
FIG. 11B is an enlarged fragmentary sectional depiction of small circular depiction of the second coloration otherwise depicted in FIG. 7 and FIG. 11A.
FIG. 11C is an enlarged fragmentary sectional depiction of small circular depiction of the first coloration otherwise depicted in FIG. 8 and FIG. 11A.
Figure 12:
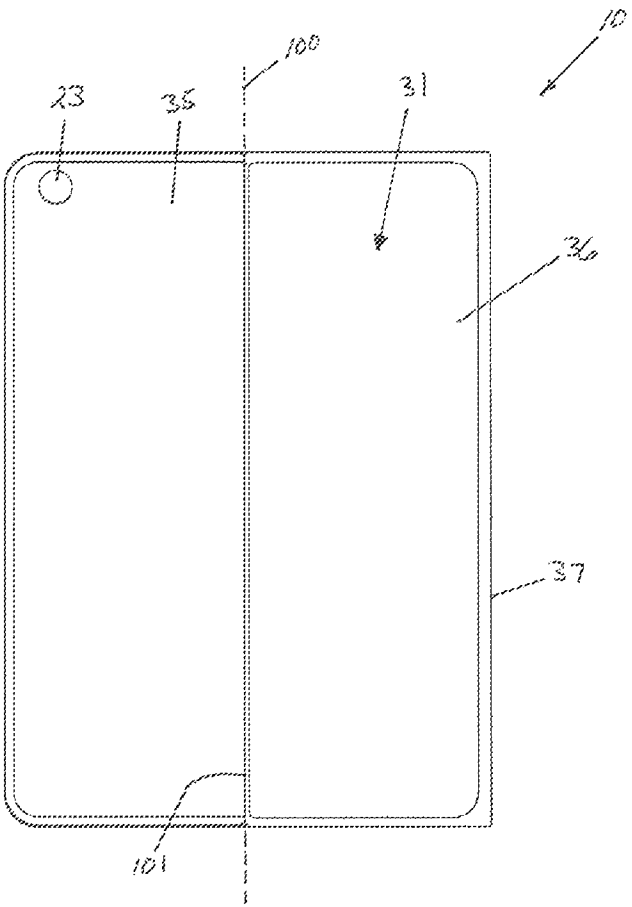
FIG. 12 is a posterior plan view of the preferred reversible case construction according to the present invention showing the posterior surfacing of the reversible case construction in a first closed configuration.
Figure 13:
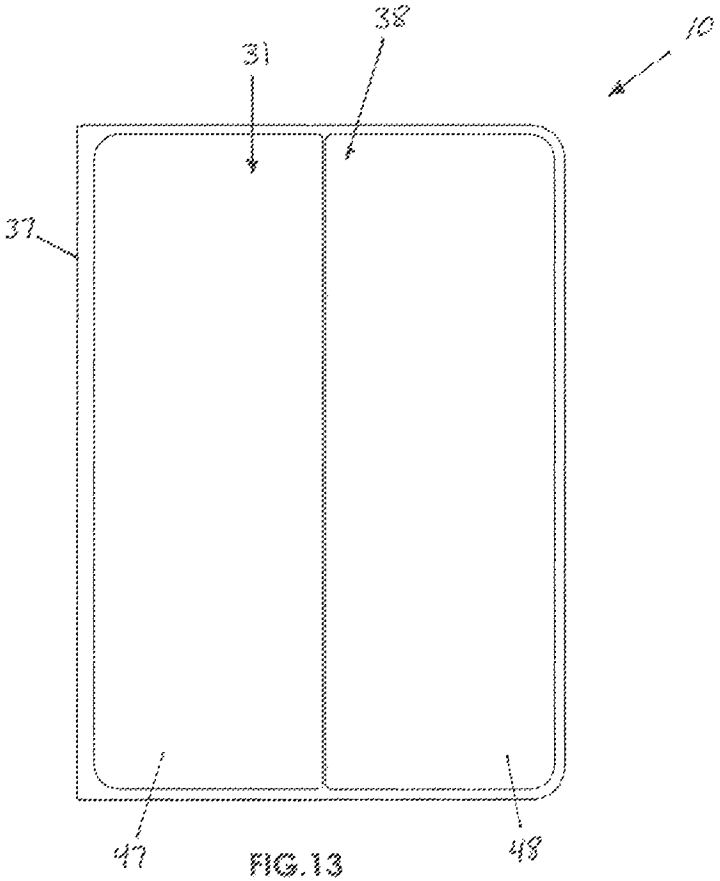
FIG. 13 is an anterior plan view of the preferred reversible case construction according to the present invention showing the anterior surfacing of the reversible case construction in the first closed configuration.
Figures 16, 16A, 16B:
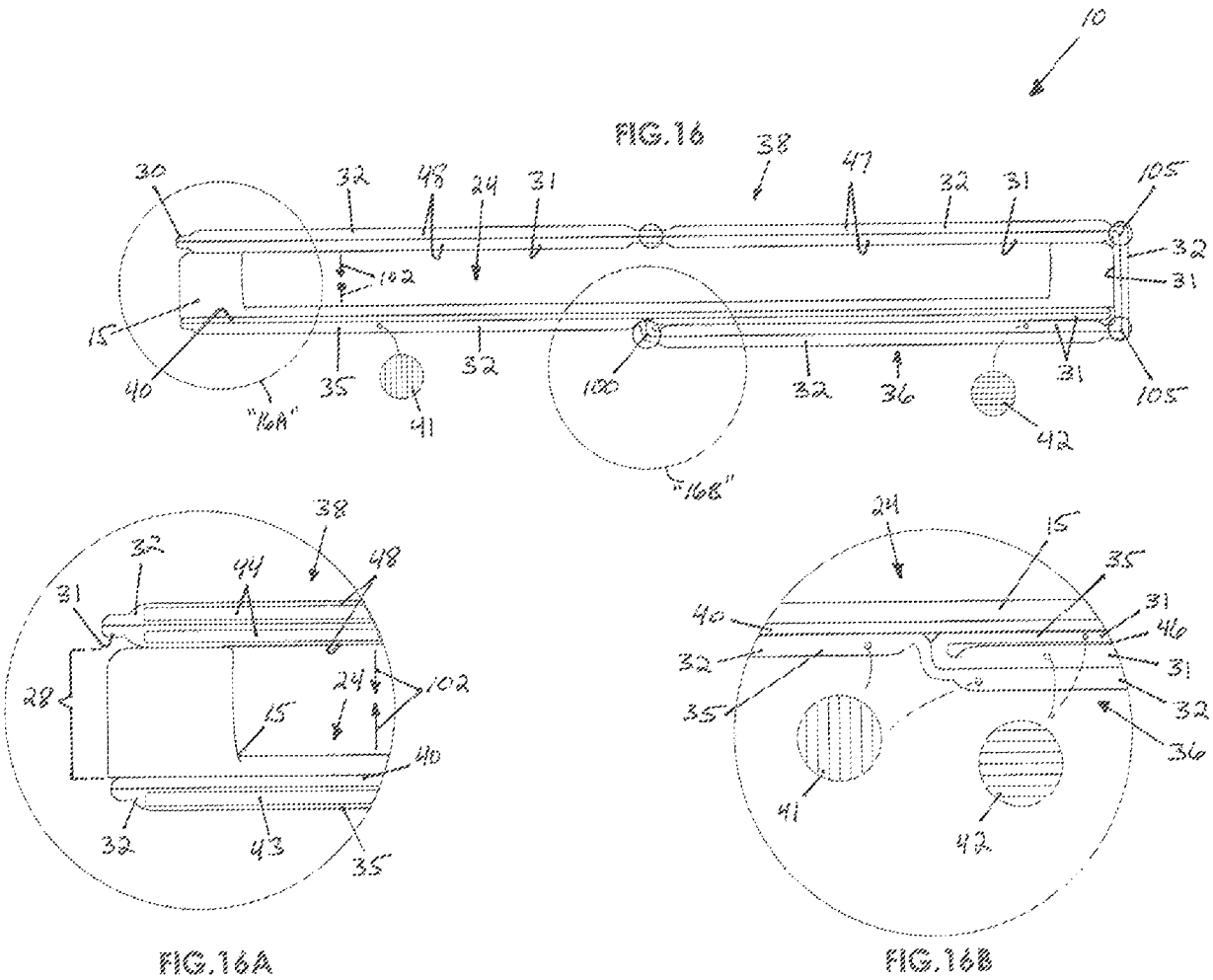
FIG. 16 is a top edge view of the preferred reversible case construction according to the present invention in the first closed configuration.
FIG. 16A is an enlarged fragmentary sectional view of the leftmost structures otherwise depicted in FIG. 16, enlarged for greater clarity of said structures.
FIG. 16B is an enlarged fragmentary sectional view of the center bottom structures otherwise depicted in FIG. 16, enlarged for greater clarity of said structures.
Figure 17:
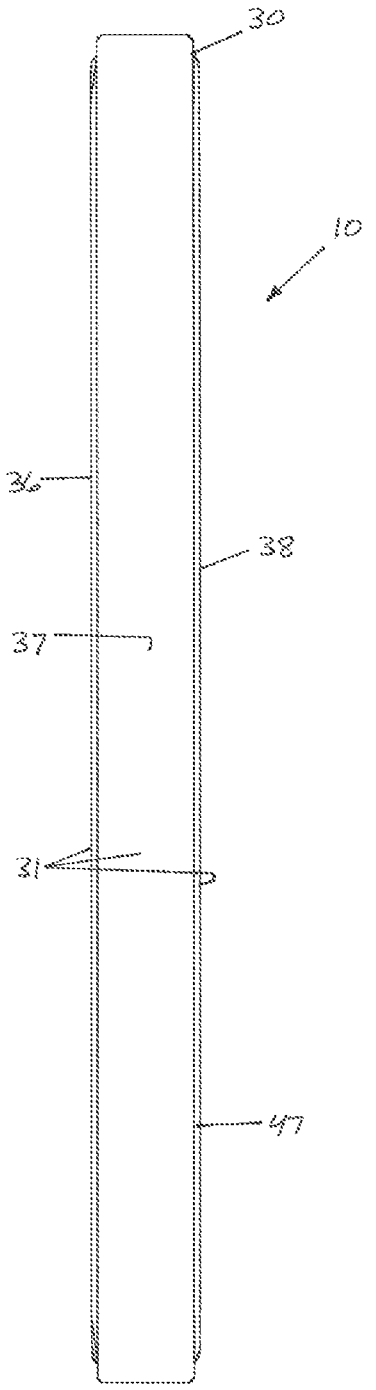
FIG. 17 is a closed lateral edge view of the preferred reversible case construction according to the present invention in the first closed configuration.
Figure 18:
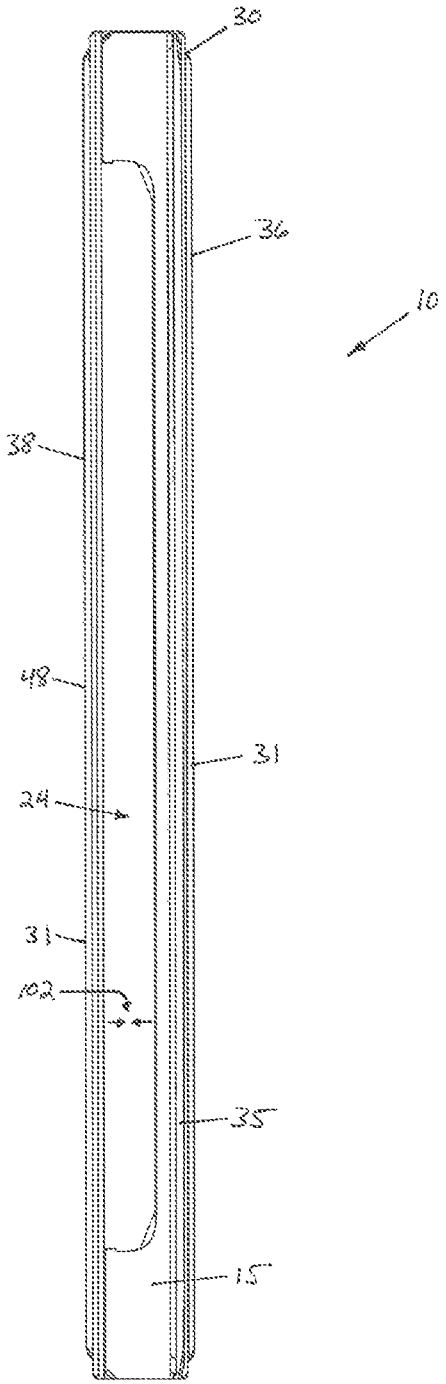
FIG. 18 is an open lateral edge view of the preferred reversible case construction according to the present invention in the first closed configuration.

FIGS. 10 and 10A depict the reversible case construction in a process of being reoriented into the closed condition and thus the cover and interface magnetic material layers 45 and 43 are not yet substantially parallel but are opposed and magnetically attractive to one another as at arrows 103 for enhancing the closed condition of the reversible case construction when in the closed configuration. FIGS. 16 and 16B may be thought of as depicting the panel assembly-to-holder interface section 35 of the first material layer or portion 31 magnetically attracted to the interface cover sections 36 via the boundary 46 therebetween.

The various magnetic material layers 43, 44, and 45 are preferably embedded within the first and second material layers or portions 31 and 32 as variously depicted, thereby adding thickness to the first and second material layers or portions 31 and 32 and forming what appear to be raised panel portions. Thus, the invention may be said to preferably comprise select magnetic material layers embedded within the first and second material portions 31 and/or 32, which select magnetic material layers are selected from the group consisting of the interface, device-encasing and cover magnetic material layers 43, 44, and 45 for enhancing the visual appeal of the reversible case construction.

Perhaps most notably in this last regard, the device-encasing sections 38 each preferably comprise a first or inner panel section as at 47, and a second or outer panel section as at 48. The second panel sections 48 are preferably pivotal relative to the first panel sections 47 about a second or secondary pivot axis as at 104 extending intermediate the first and second panel sections 47 and 48. The reader is directed to FIG. 19, which figure more or less diagrammatically depicts a reversible case construction in an open configuration such that the device-holding mechanism 15 is supported via the folded or pivoted reversible panel assembly of the reversible case construction.

Figures 19, 19A:
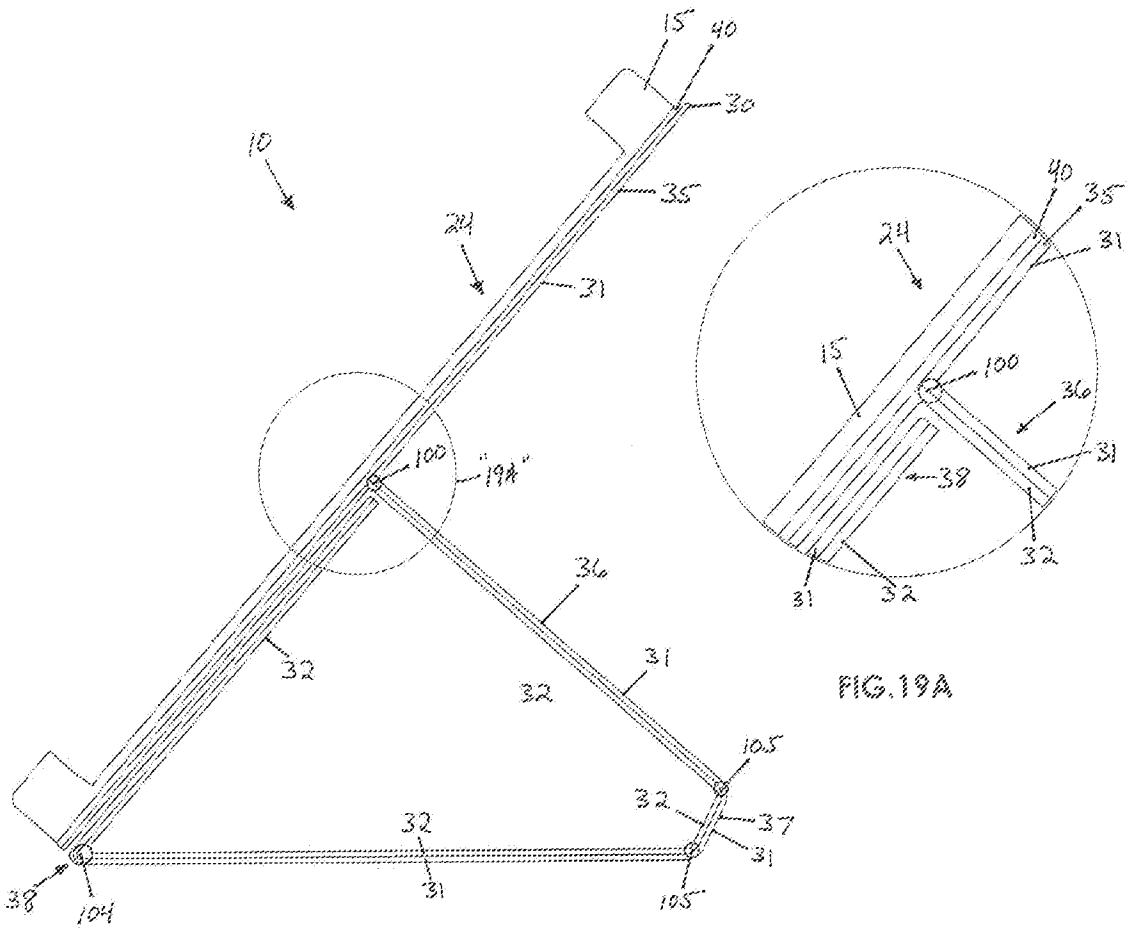
FIG. 19 is a lateral edge view of a diagrammatic reversible case construction according to the present invention shown in a first open condition of use.
FIG. 19A is an enlarged fragmentary sectional view of the center structures otherwise depicted in FIG. 19, enlarged for greater clarity of said structures.
Figure 20:
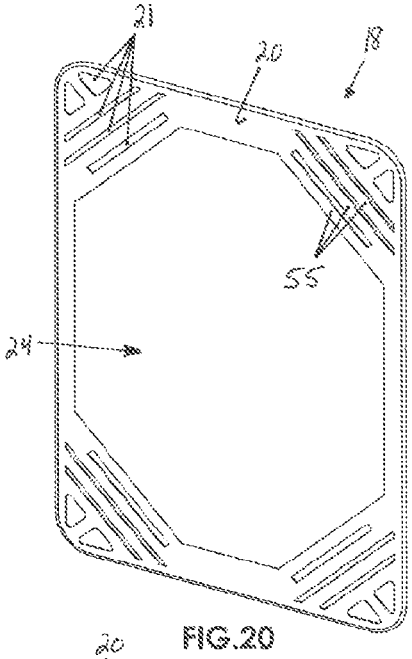
FIG. 20 is a first frontal perspective of a second alternative device-holding mechanism according to the present invention.
Figure 20A:
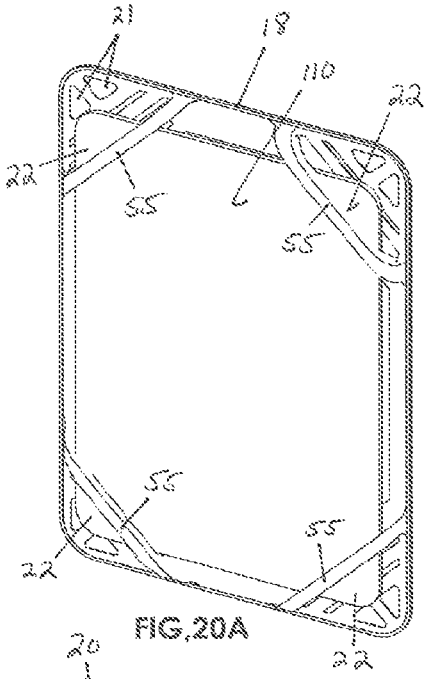
FIG. 20A is a second frontal perspective of the second alternative device-holding mechanism according to the present invention shown holding a generic electronic device.
Figure 21:
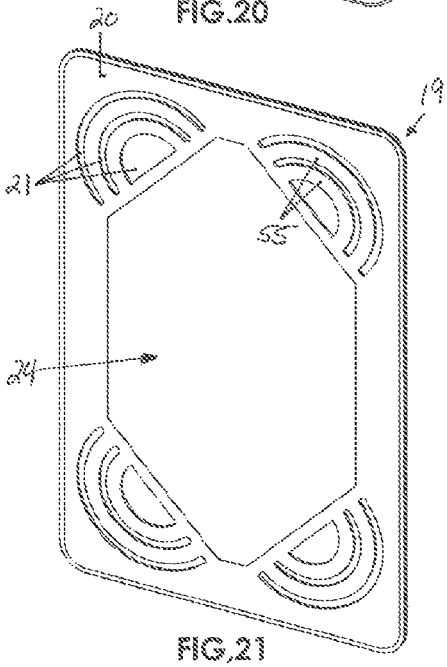
FIG. 21 is a first frontal perspective of a third alternative device-holding mechanism according to the present invention.
Figure 21A:
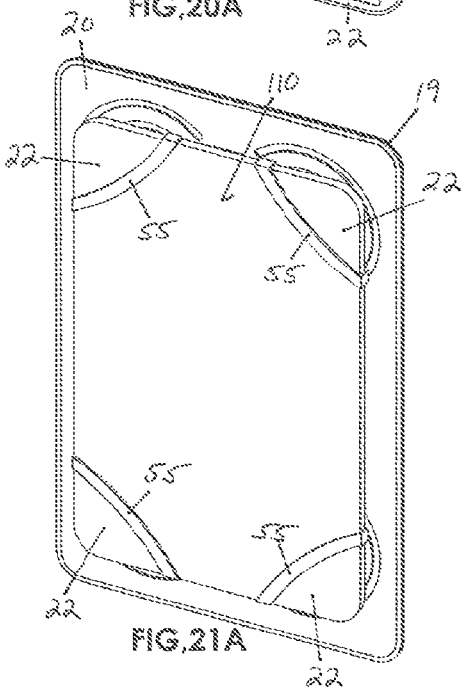
FIG. 21A is a second frontal perspective of the third alternative device-holding mechanism according to the present invention shown holding a generic electronic device.
Figure 23:
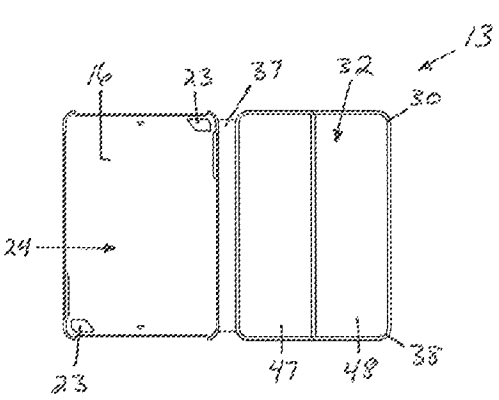
FIG. 23 is a reduced frontal plan view of a third alternative embodiment of the reversible case construction according to the present invention in the second open configuration and showing a fifth alternative device-holding mechanism.
Figure 22:
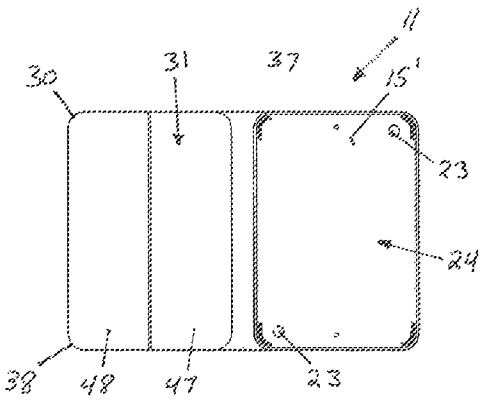
FIG. 22 is a reduced frontal plan view of a second alternative embodiment of the reversible case construction according to the present invention in the first open configuration and showing a fourth alternative device-holding mechanism.

In other words, the first and second panel sections 47 and 48 may thus function to form basal support for the device-holding mechanism (as at 15 in FIG. 19) for enabling the user to support the device-holding mechanism in an oblique orientation relative to the first panel section(s) 47 when in an open case configuration as generally depicted in FIG. 19. Third and fourth or tertiary pivot axes as at 105 are located at the edges of and thus bound the holder-device edge-traversing section 37 for enhancing the basal support functionality as depicted in FIG. 19, and further for enabling full device enclose via the reversible panel assembly as generally depicted in FIGS. 10, 10A, and 16.

Figure 14:
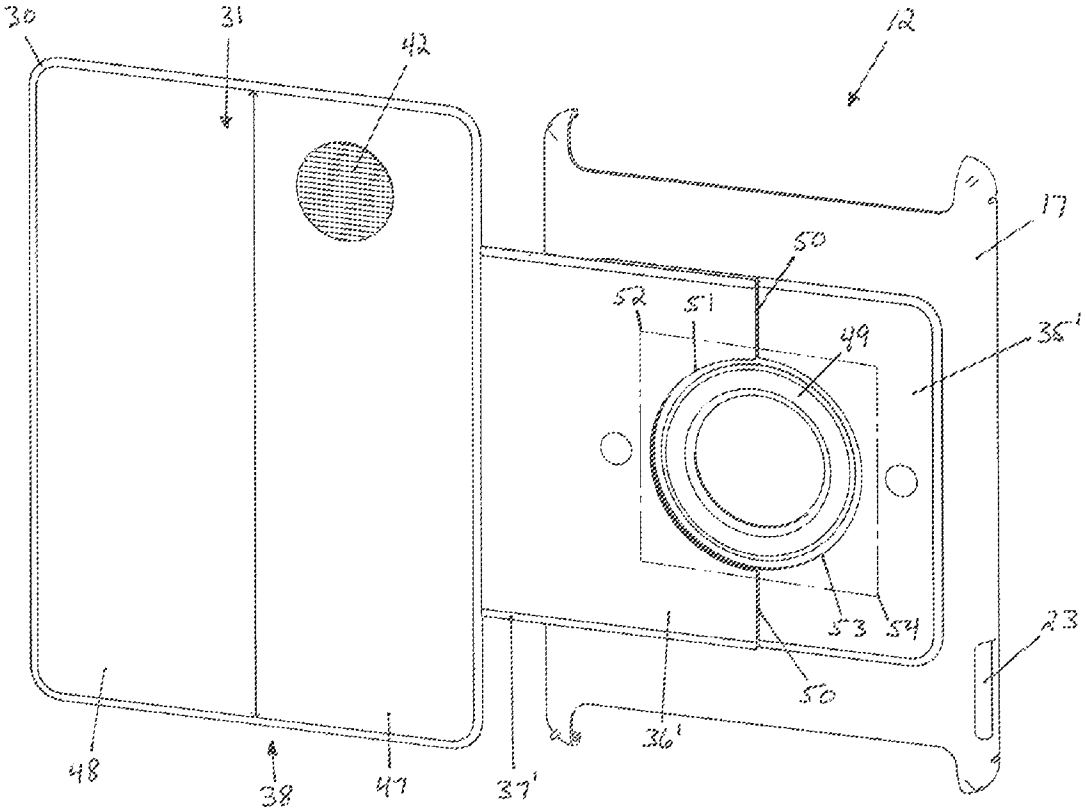
FIG. 14 is a first rear perspective view of a first alternative reversible case construction according to the present invention showing a first alternative device-holding mechanism and showing the cradle-covering portion in the second open configuration and showing the second side of the cradle-covering portion with first coloration depicted in a small circular section.
Figure 15:
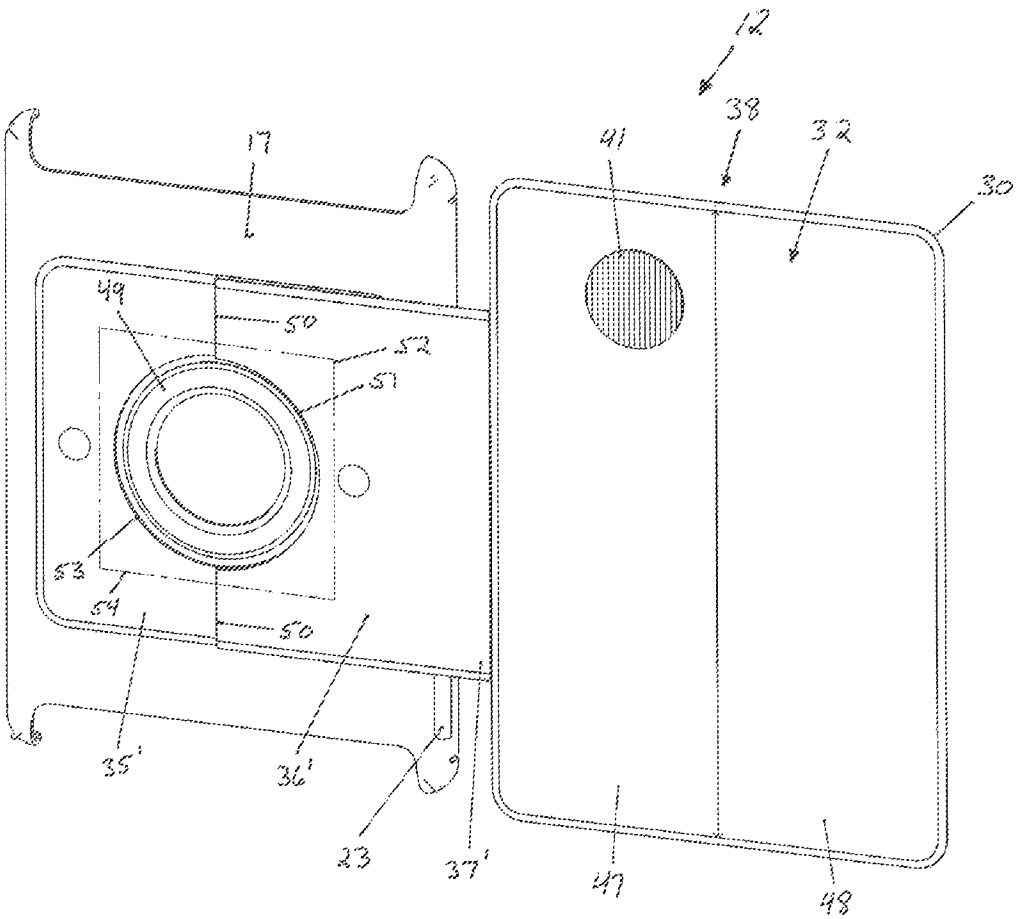
FIG. 15 is a second rear perspective view of the first alternative reversible case construction according to the present invention showing the first alternative device-holding mechanism and showing the cradle-covering portion in the first open configuration and showing the first side of the cradle-covering portion with second coloration depicted in a small circular section.
Figure 25:
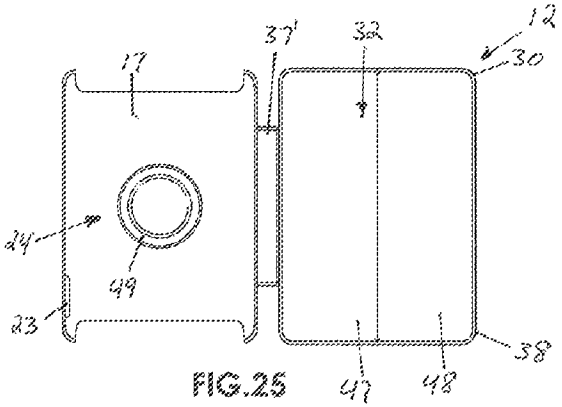
FIG. 25 is a reduced frontal plan view of the first alternative embodiment of the reversible case construction according to the present invention in the second open configuration and showing the first alternative device-holding mechanism.
Figure 24:
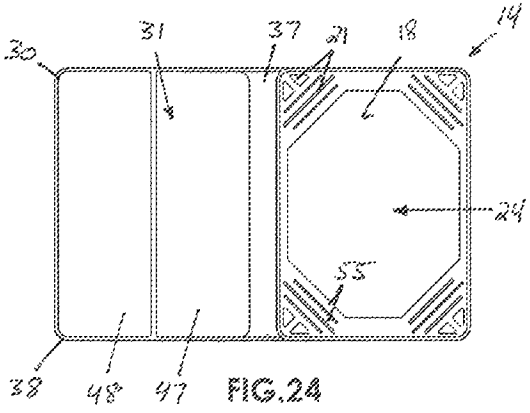
FIG. 24 is a reduced frontal plan view of a fourth alternative embodiment of the reversible case construction according to the present invention in the first open configuration and showing the second alternative device-holding mechanism.

With regard to the rotatable cradle embodiment depicted and referenced at 12 in FIGS. 14, 15, and 25, the reader will see that the interface-cover sections are slightly modified as compared to interface-cover sections 36 and thus have been referenced at 36'. The cover sections 36' are pivotally attached to the panel assembly-to-holder interface sections 35' at opposed attachment points 50 opposite interface section apertures formed in the cover sections 36'. The interface section apertures formed in the cover sections 36' coincide with apertures formed in the panel assembly-to-holder interface sections 35', and may be of any number of shaped formations.

A semi-circular formation as at 51 and a rectangular formation as at 52 have been illustrated in the cover sections 36' for the purpose of exemplifying this concept. The semi-circular formation 51 and the rectangular formation 52 coincide with semi-circular formation as at 53 and rectangular formation as at 54 formed in the panel assembly-to-holder interface sections 35'. The formations here exemplified are contemplated for structurally accommodating a rotation mechanism as at 49 rotatably attaching or connecting the device-holding mechanism to the panel assembly-to-holder interface sections 35' (optionally via structural layer 40). Generally speaking the top-to-bottom dimensions of the sections 35', 36' and 37' are relatively abbreviated as compared to sections 35, 36, and 37.

While the above descriptions contain much specificity, this specificity should not be construed as limitations on the scope of the invention, but rather as an exemplification of the invention. The basic invention may be said to essentially teach or disclose a reversible case construction for encasing an electronic device and selectively displaying an outer case material. The reversible case construction essentially comprises a device-holding mechanism or device-holding means sized and shaped to removably receive and hold an electronic device.

The reversible case construction further essentially comprises a device-concealing reversible panel assembly. The device-concealing reversible panel assembly comprises first and second material portions, each of which preferably comprise inner surfacing, outer surfacing, a panel assembly-to-holder interface section, an interface-cover section, and a device-encasing section. The inner surfacing of the interface-cover sections and device-encasing sections are attached to one another.

The inner surfacing of the panel assembly-to-holder interface sections are attached to structure associated with the device-holding mechanism for providing an interface panel layer. The reversible panel assembly is pivotal relative to the interface panel layer about a first pivot axis located adjacent interface panel layer. The first and second material portions are thereby being selectively presentable for displaying the outer case material.

The device-concealing panel assembly of the reversible case construction may further preferably comprise an interface structural layer. The interface structural layer is preferably attached to the device-holding mechanism and the inner surfacing for connecting the device-concealing panel assembly to the device-holding mechanism or means.

The first and second material portions of the reversible case construction preferably comprise differing physical properties for enabling the user to select a preferred physical property from the group consisting of the differing physical properties for outward presentation. More particularly, the first and second material portions may preferably comprise differing visual properties for enabling the user to select a preferred visual property from the group consisting of the differing visual properties for outward presentation of the preferred visual property.

The panel assembly-to-holder interface sections may preferably comprise an interface magnetic material layer and the device-encasing sections may preferably comprise an encasing magnetic material layer. The interface and encasing magnetic material layers are substantially parallel and opposed and magnetically attractive to one another when the reversible case construction is in a closed configuration for generally enhancing the closed condition of the reversible case construction via magnetically attractive forces between the magnetic material layers.

The interface-cover sections may also comprise a cover magnetic material layer such that the cover and interface magnetic material layers are substantially parallel, opposed, and magnetically attractive to one another for further enhancing the closed condition. Select magnetic material layers are preferably embedded within the first and second material portions for enhancing the overall visual appeal of the reversible case construction. The select magnetic material layers are selected from the group consisting of the interface, device-encasing and cover magnetic material layers.

The device-encasing sections may preferably first and second panel sections. The second panel sections are preferably pivotal relative to the first panel sections about a second pivot axis extending intermediate the first and second panel sections. The pivotal first and second panel sections may thus form basal support for the device-holding mechanism and enable the user to support the device-holding mechanism in an oblique orientation relative to the first panel sections when the reversible case construction is in an open configuration.

In an alternative embodiment, the interface-cover sections are preferably pivotally attached to the panel assembly-to-holder interface sections at opposed attachment points opposite an interface section aperture. In this embodiment, the interface section aperture basically functions to accommodate a rotation mechanism, which rotation mechanism rotatably connects the device-holding mechanism to the panel assembly-to-holder interface sections.

Accordingly, although the inventive reversible case construction has been described by reference to a number of embodiments, it is not intended that the novel case construction be limited thereby, but that modifications thereof are intended to be included as falling within the broad scope and spirit of the foregoing disclosure, the following claims, and the appended drawings.

I claim:

1. A reversible case construction for encasing an electronic device and selectively displaying an outer case material, the reversible case construction comprising:

a device-holding mechanism, the device-holding mechanism being sized and shaped to removably receive an electronic device, the device-holding mechanism comprising an anterior device-receiving section and posterior holder surfacing; and a multi-layer, multi-section device-concealing panel assembly, the multi-layer, multi-section device-concealing panel assembly comprising a first material portion and a second material portion, the first and second material portions each comprising inner attachment surfacing, outer exposable surfacing, a panel assembly-to-holder interface section, an interface-cover section, and a device-encasing section, the inner attachment surfacing of the interface-cover sections and device-encasing sections being attached to one another for providing a reversible panel assembly, the inner attachment surfacing of the panel assembly-to-holder interface sections being attached to structure associated with the device-holding mechanism for providing a bifurcated interface panel layer, the reversible panel assembly being pivotal relative to the bifurcated interface panel layer about a first pivot axis located adjacent a line of bifurcation in the bifurcated interface panel layer, the first and second material portions thereby being selectively presentable for displaying the outer case material.

2. The reversible case construction of claim 1 wherein the multi-layer, multi-section device-concealing panel assembly comprises an interface structural layer, the interface structural layer being attached to the posterior holder surfacing and the inner interface surfacing for connecting the multi-layer, multi-section device-concealing panel assembly to the device-holding mechanism.

3. The reversible case construction of claim 1 wherein the first and second material portions comprise differing physical properties, the differing physical properties for enabling the user to select a preferred physical property from the group consisting of the differing physical properties for outward presentation of the preferred physical property.

4. The reversible case construction of claim 3 wherein the first and second material portions comprise differing visual properties, the differing visual properties for enabling the user to select a preferred visual property from the group consisting of the differing visual properties for outward presentation of the preferred visual property.

5. The reversible case construction of claim 1 wherein the panel assembly-to-holder interface sections comprise an interface magnetic material layer and the device-encasing sections comprise an encasing magnetic material layer, the interface and encasing magnetic material layers being substantially parallel and opposed and magnetically attractive to one another when the reversible case construction is in a closed configuration for enhancing the closed condition of the reversible case construction.

6. The reversible case construction of claim 5 wherein the interface-cover sections comprise a cover magnetic material layer, the cover and interface magnetic material layers being substantially parallel, opposed, and magnetically attractive to one another for enhancing the closed condition.

7. The reversible case construction of claim 6 wherein select magnetic material layers are embedded within the first and second material portions, the select magnetic material layers being selected from the group consisting of the interface, device-encasing and cover magnetic material layers, the select magnetic material layers being so embedded for enhancing the visual appeal of the reversible case construction.

8. The reversible case construction of claim 1 wherein the device-encasing sections comprise first and second panel sections, the second panel sections being pivotal relative to the first panel sections about a second pivot axis extending intermediate the first and second panel sections, the first and second panel sections for forming basal support for the device-holding mechanism and for enabling the user to support the device-holding mechanism in an oblique orientation relative to the first panel sections when the reversible case construction is in an open configuration.

9. The reversible case construction of claim 1 wherein the interface-cover sections are pivotally attached to the panel assembly-to-holder interface sections at opposed attachment points opposite an interface section aperture, the interface section aperture for accommodating a rotation mechanism, the rotation mechanism rotatably connecting the device-holding mechanism to the panel assembly-to-holder interface sections.

10. A reversible case construction for encasing an electronic device and selectively displaying an outer case material, the reversible case construction comprising:

a device-holding mechanism, the device-holding mechanism being sized and shaped to removably receive an electronic device; and a device-concealing panel assembly, the device-concealing panel assembly comprising first and second material portions, the first and second material portions each comprising inner surfacing, outer surfacing, a panel assembly-to-holder interface section, an interface-cover section, and a device-encasing section, the inner surfacing of the interface-cover sections and device-encasing sections being attached to one another for providing a reversible case panel assembly, the inner surfacing of the panel assembly-to-holder interface sections being attached to structure associated with the device-holding mechanism for providing an interface panel layer, the reversible panel assembly being pivotal relative to the interface panel layer about a first pivot axis located adjacent interface panel layer, the first and second material portions thereby being selectively presentable for displaying the outer case material.

11. The reversible case construction of claim 10 wherein the device-concealing panel assembly comprises an interface structural layer, the interface structural layer being attached to the device-holding mechanism and the inner surfacing for connecting the device-concealing panel assembly to the device-holding mechanism.

12. The reversible case construction of claim 10 wherein the first and second material portions comprise differing physical properties, the differing physical properties for enabling the user to select a preferred physical property from the group consisting of the differing physical properties for outward presentation of the preferred physical property.

13. The reversible case construction of claim 12 wherein the first and second material portions comprise differing visual properties, the differing visual properties for enabling the user to select a preferred visual property from the group consisting of the differing visual properties for outward presentation of the preferred visual property.

14. The reversible case construction of claim 10 wherein the panel assembly-to-holder interface sections comprise an interface magnetic material layer and the device-encasing sections comprise an encasing magnetic material layer, the interface and encasing magnetic material layers being substantially parallel and opposed and magnetically attractive to one another when the reversible case construction is in a closed configuration for enhancing the closed condition of the reversible case construction.

15. The reversible case construction of claim 14 wherein the interface-cover sections comprise a cover magnetic material layer, the cover and interface magnetic material layers being substantially parallel, opposed, and magnetically attractive to one another for enhancing the closed condition.

16. The reversible case construction of claim 15 wherein select magnetic material layers are embedded within the first and second material portions, the select magnetic material layers being selected from the group consisting of the interface, device-encasing and cover magnetic material layers, the select magnetic material layers being so embedded for enhancing the visual appeal of the reversible case construction.

17. The reversible case construction of claim 10 wherein the device-encasing sections comprise first and second panel sections, the second panel sections being pivotal relative to the first panel sections about a second pivot axis extending intermediate the first and second panel sections, the first and second panel sections for forming basal support for the device-holding mechanism and for enabling the user to support the device-holding mechanism in an oblique orientation relative to the first panel sections when the reversible case construction is in an open configuration.

18. The reversible case construction of claim 10 wherein the interface-cover sections are pivotally attached to the panel assembly-to-holder interface sections at opposed attachment points opposite an interface section aperture, the interface section aperture for accommodating a rotation mechanism, the rotation mechanism rotatably connecting the device-holding mechanism to the panel assembly-to-holder interface sections.

19. A reversible case construction for encasing an electronic device and selectively displaying an outer case material, the reversible case construction comprising:

device-holding means for holding an electronic device; and a reversible panel assembly, the reversible panel assembly comprising first and second material portions, the first and second material portions each comprising inner surfacing, outer surfacing, an interface-cover section and a device-encasing section, the inner surfacing of the interface-cover sections and device-encasing sections being attached to one another, the reversible panel assembly being pivotal relative to the device-holding means about a first pivot axis, the first and second material portions thereby being selectively presentable for displaying the outer case material.

20. The reversible case construction of claim 19 wherein the reversible panel assembly comprises a panel assembly-to-holder interface layer, the inner surfacing of the panel assembly-to-holder interface sections being attached to structure associated with the device-holding means.

* * * * *